US010494249B1

(12) United States Patent
Feldner

(10) Patent No.: US 10,494,249 B1
(45) Date of Patent: Dec. 3, 2019

(54) FOOD PRODUCT DISPENSERS HAVING LEVERS WITH SLIDABLE PIVOT ENDS

(71) Applicant: Server Products, Inc., Richfield, WI (US)

(72) Inventor: Paul Feldner, Richfield, WI (US)

(73) Assignee: Server Products, Inc., Richfield, WI (US)

( * ) Notice: Subject to any disclaimer, the term of this patent is extended or adjusted under 35 U.S.C. 154(b) by 0 days.

(21) Appl. No.: 16/050,067

(22) Filed: Jul. 31, 2018

(51) Int. Cl.
*B67D 7/02* (2010.01)

(52) U.S. Cl.
CPC ..... *B67D 7/0205* (2013.01)

(58) Field of Classification Search
CPC ..... B67D 7/0205
USPC ..... 222/321.8, 340, 372, 381, 382, 383.3, 222/385, 402.13, 473
See application file for complete search history.

(56) References Cited

U.S. PATENT DOCUMENTS 1,561,182 A * 11/1925 Morlok ..... B67D 7/0205 222/195
1,739,195 A 12/1929 Wheeler
1,947,088 A * 2/1934 Johnson ..... F16N 3/12 222/318
2,048,142 A * 7/1936 Santurello ..... B05B 11/3004 222/324
2,540,890 A * 2/1951 Kestenbaum ..... B67D 7/0205 222/384
2,657,833 A * 11/1953 Steczynski ..... B67D 1/02 222/309
3,332,585 A * 7/1967 Cox ..... B67D 1/02 222/309
3,393,840 A 7/1968 Sundholm
4,492,319 A * 1/1985 Cooper ..... B65D 25/385 220/88.1
4,662,544 A * 5/1987 Gillispie ..... B05B 11/3004 137/846
5,375,746 A 12/1994 Schaefer et al.
5,435,463 A 7/1995 Holdgson
5,452,826 A * 9/1995 Stern ..... B05B 11/303 222/207
6,089,406 A * 7/2000 Feldner ..... B67D 7/80 222/103
7,377,408 B2 5/2008 Kasting et al.
9,739,417 B2 8/2017 Maser

* cited by examiner

*Primary Examiner* — Vishal Pancholi
(74) *Attorney, Agent, or Firm* — Andrus Intellectual Property Law, LLP

(57) ABSTRACT

A food product dispenser for dispensing a food product from a container includes a lid configured to couple to the container and a pump coupled to the lid and having a cylinder and a piston assembly with a piston rod and a piston that is reciprocated in the cylinder. A lever having a piston end B pivotably coupled to the piston rod. An opposite, pivot end of the lever slidably coupled to the lid such that the lever pivots about a pivot axis. The pivot end slides along the lid and the piston end acts on the piston assembly with a primarily vertical force that reciprocates the piston assembly and dispenses the food product.

18 Claims, 6 Drawing Sheets

FOOD PRODUCT DISPENSERS HAVING LEVERS WITH SLIDABLE PIVOT ENDS

FIELD

The present disclosure generally relates to a food product dispenser for dispensing liquid or semi-liquid food products. More specifically, the present disclosure relates to a food product dispenser having a lever with a pivot end that slides as the lever is pivoted.

BACKGROUND

Food product dispensers are found in restaurants, fast food establishments, convenience stores, and the like and are configured to dispense liquid or semi-liquid food products, such as syrups, fudges for ice cream, condiments, sandwich toppings, and dairy products.

Conventional food product dispensers typically include a container that holds a supply of the food product to be dispensed. The food product is poured from a storage container, such as a can or flexible pouch, into the container where the food product held until it is dispensed. In some food product dispensers, the food product is refrigerated or heated while the food product is in the container. The food product dispenser includes a pump, such as a hand-operated piston pump, at least partially submerged in the food product such that actuation of the pump dispenses the food product. The present inventors have recognized that high-viscosity food products, such as liquid fudge and nacho cheese, often require that a large force to be applied to the pump in order to dispense the food product. Accordingly, through research and experimentation, the present inventors have developed the food product dispenser of the present disclosure that has a lever with a slidable pivot end such that the operator can apply primarily vertical forces to the pump such that the food product can be dispensed from the container with ease and lateral forces and stresses acting on the pump are reduced or eliminated.

The following U.S. Patent is incorporated herein by reference in entirety:

U.S. Pat. No. 5,375,746 discloses a hand operated piston displacement-type pump having a one-piece valve body retaining a removable cylinder and discharge tube, for dispensing prescribed portions of complex fluids, such as food products or liquids with suspended solids, at a desired point outside of a storage container. Valve ball control of the flow of the product is obtained with the combination of the precision channels in the valve body and in the bottom of the cylinder and discharge tube. The valve body includes structure necessary for seal and connection to allow the cylinder and discharge tube to be removed, without tools, for cleaning.

SUMMARY

This Summary is provided to introduce a selection of concepts that are further described below in the Detailed Description. This Summary is not intended to identify key or essential features of the claimed subject matter, nor is it intended to be used as an aid in limiting the scope of the claimed subject matter.

In certain examples, a food product dispenser for dispensing a food product from a container includes a lid configured to couple to the container and a pump coupled to the lid and having a cylinder and a piston assembly with a piston rod and a piston that is reciprocated in the cylinder. Reciprocation of the piston assembly pumps the food product from the container. A lever having a piston end pivotably coupled to the piston rod and an opposite, pivot end with a pivot axis pivotably and slidably coupled to the lid is pivoted about the pivot axis such that the pivot end to slides along the lid and the piston end acts on the piston assembly with a primarily vertical force that reciprocates the piston assembly.

In certain examples, a food product dispenser for dispensing a food product includes a container having a cavity in which the food product is received, a lid coupled to the container, and a pump coupled to the lid. The lid includes a slide bracket having an open end, an opposite, closed end, and a pair of channels separated by a shared center wall that extend between the open end and the closed end. The pump includes a cylinder and a piston assembly that is reciprocated in the cylinder to thereby pump the food product from the container. The piston assembly has a piston rod and a piston. A lever includes a piston end pivotably coupled to the piston rod and an opposite, pivot end pivotably and slidably coupled to the lid. The pivot end has a pivot axis about which the lever is pivoted, an inner perimeter surface that defines an access slot that extends from the pivot end toward the piston end to thereby define two arms, and a tab that extends from each arm along the pivot axis and into the access slot. The tabs are slidably and pivotably received in the pair of channels. In operation, pivoting of the lever about the pivot axis causes the tabs to simultaneously slide in the pair of channels and the piston end act on the piston assembly with a primarily vertical force that reciprocates the piston assembly.

In certain examples, a food product dispenser for dispensing a food product from a container includes a lid configured to couple to the container and a pump coupled to the lid and having a cylinder and a piston assembly having a piston rod and a piston that is reciprocated in the cylinder. Reciprocation of the piston assembly pumps the food product from the container. A lever has a first end coupled to one of the piston assembly and the lid and an opposite, second end coupled to the other of the piston assembly and the lid. The first end is pivotably coupled to the piston assembly or the lid, and the second end is pivotably and slidably coupled to the piston assembly or the lid. The lever pivots about a pivot axis positioned at the first end or the second end such that the lever acts on the piston assembly with a primarily vertical force to reciprocate the piston assembly.

Various other features, objects, and advantages will be made apparent from the following description taken together with the drawings.

BRIEF DESCRIPTION OF THE DRAWINGS

The present disclosure is described with reference to the following Figures. The same numbers are used throughout the Figures to reference like features and like components.

DETAILED DESCRIPTION

Figure 1:
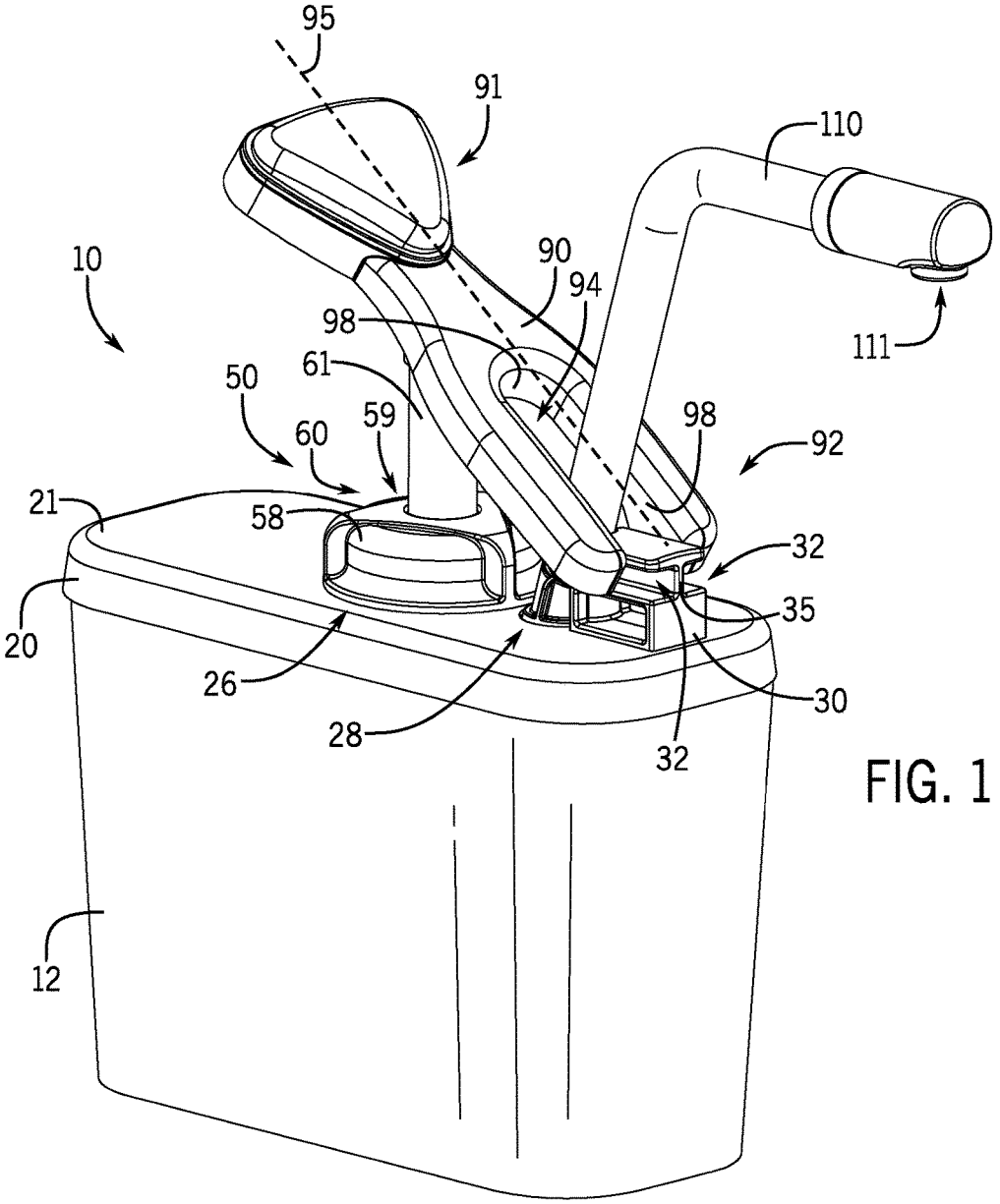
FIG. 1 is a perspective view of an example food product dispenser of the present disclosure.
Figure 2:
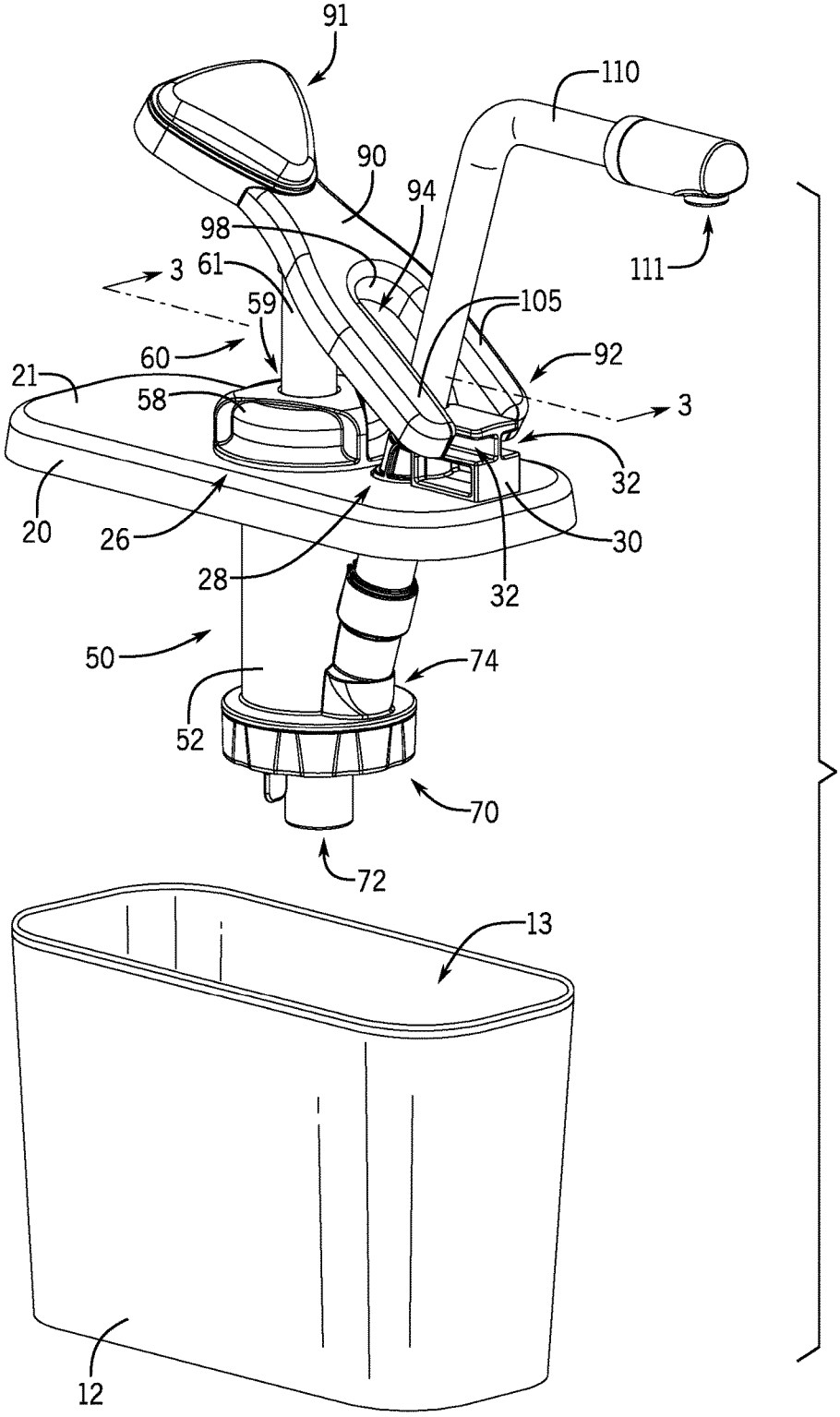
FIG. 2 is a partially exploded view of the food product dispenser shown in FIG. 1.

FIGS. 1-9 depict an example food product dispenser 10 of the present disclosure for dispensing food product from a container 12. The container 16 defines a cavity 13 in which the food product, such as syrups, fudges for ice cream, and condiments, is received. The food product dispenser 10 includes a lid 20 that securely attaches to the container 12 after the food product is placed into the cavity 13. The lid 20 has a first, upper lid surface 21 and an opposite second, lower lid surface 22. The lower lid surface 22 is immediately adjacent to the cavity 13 when the lid 20 is mounted on the container 16. The lid 20 defines a first hole 26 in which a pump 50 (described herein) is disposed and a second hole 28 in which a discharge tube 110 (described herein) is disposed.

Figure 5:
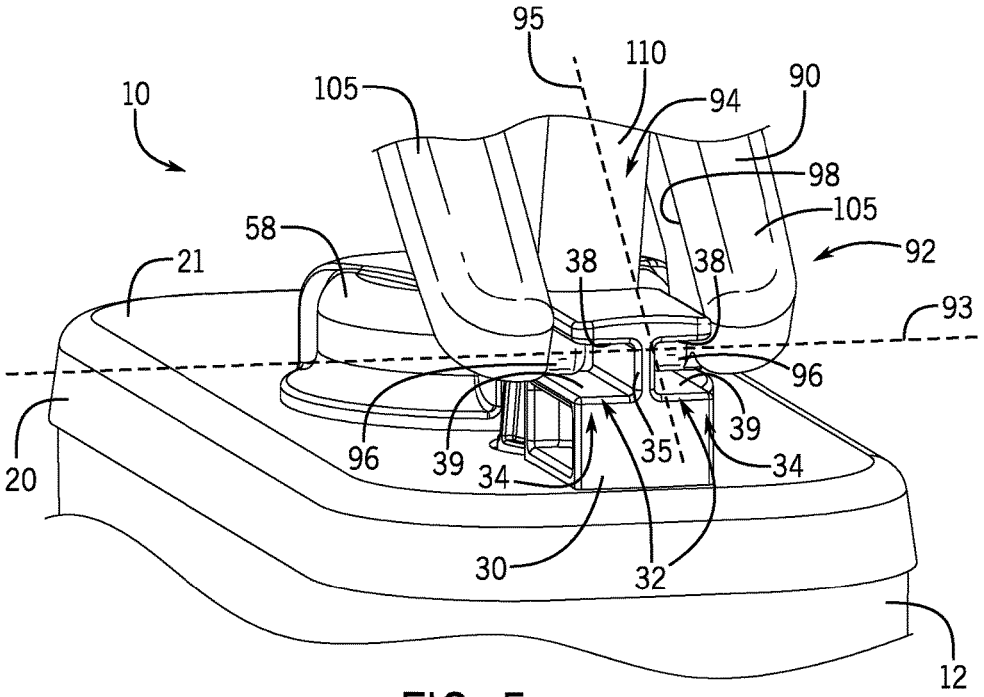
FIG. 5 is a front perspective view of the food product dispenser shown in FIG. 1.
Figure 9:
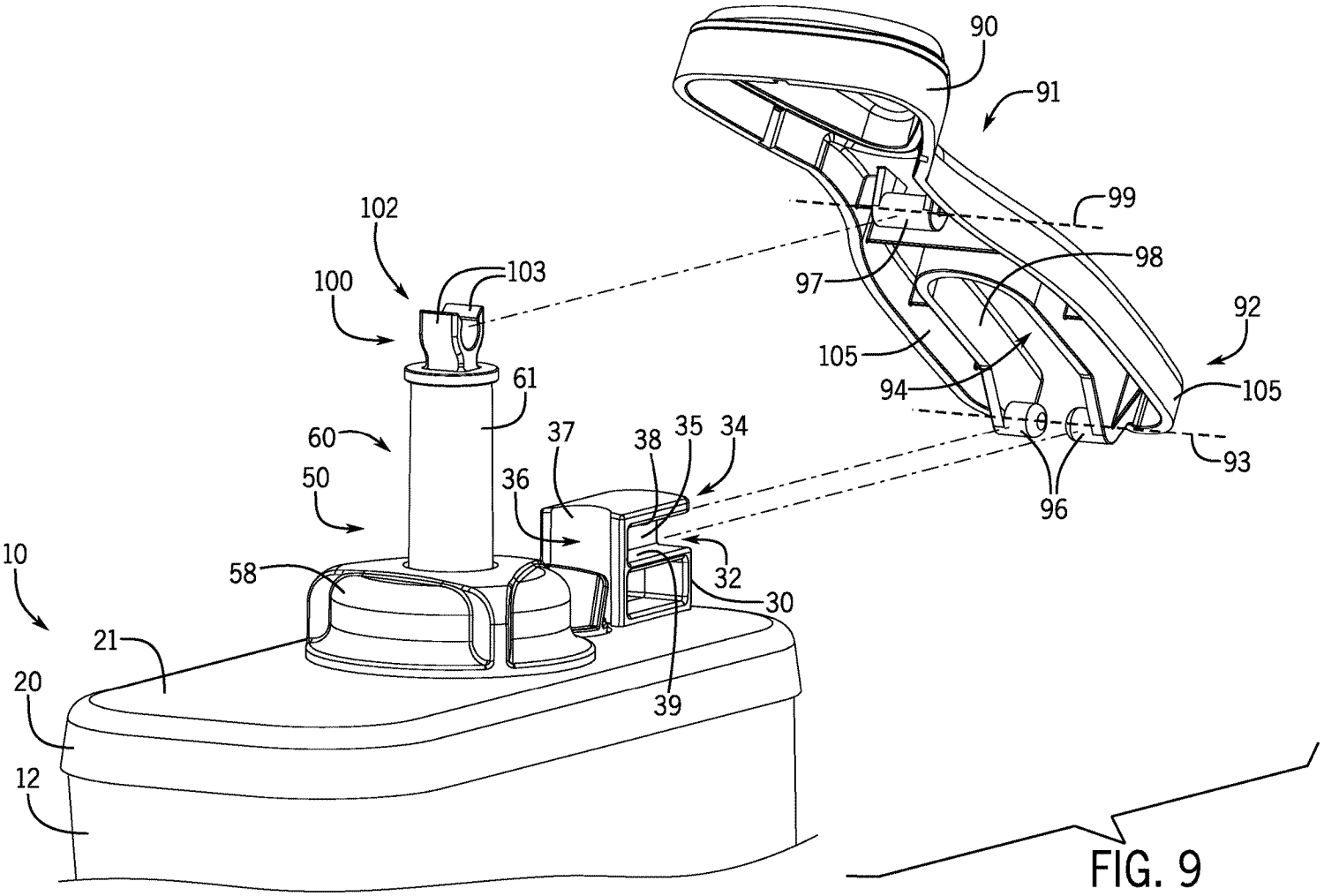
FIG. 9 is a partially exploded view of the dispenser shown in FIG. 1.

As best shown in FIGS. 1 and 9, the lid 20 includes a slide bracket 30 mounted to the upper lid surface 21 and extending therefrom. The slide bracket 30 has an open end 34, a closed end 36 having an end wall 37, and a pair of channels 32 defined between the open end 34 and the closed end 36 and each having an upper channel surface 38 and a lower channel surface 39. The pair of channels 32 are separated by a center wall 35. Each of the channels 32 are configured to receive a tab 96 of a pump lever 90 and permit the tab 96 to slide therein. The channels 32 are vertically above the upper lid surface 21, and the upper lid surface 21, the upper channel surface 38, and the lower channel surface 39 are parallel to each other. The channels 32 also define a plane 31 (FIG. 3) parallel to the upper lid surface 21 and along which the tabs 96 can slide. Referring specifically to FIG. 5, the example bracket 30 depicted includes the pair of channels 32 that are orientated opposite each other (mirror image) and are separated by the shared center wall 35. The channels 32 are defined by corresponding end walls 37, upper channel surfaces 38, and lower channel surfaces 39.

The food product dispenser 10 has a pump 50 coupled to the lid 20 and configured to pump the food product from the container 12 as a result of operation by the operator. The type of pump 50 can vary, and in the example depicted, the pump 50 is a hand-operated piston pump having a cylinder 52 that extends through the first hole 26 of the lid 20. The cylinder 52 has a flange 54 that abuts the lower lid surface 22, and the pump 50 has a collar 58 that engages with the cylinder 52 to thereby secure the cylinder 52 to the lid 20. Specifically, the collar 58 securely fastens, via screw threads, to the cylinder 52 (which has corresponding screw threads) such that the collar 58 abuts the upper lid surface 21 and the lid 20 is sandwiched between the collar 58 and the flange 54. The collar 58 defines a collar hole 59 that slidably receives a piston rod 61 (described herein below).

The pump 50 includes a piston assembly 60 having a piston rod 61 and a piston 64 that is reciprocated in the cylinder 52 to thereby pump the food product. The pump 50 also includes a valve body 70 coupled to the cylinder 52. The cylinder 52 and/or the valve body 70 is at least partially submerged in the food product during operation. The valve body 70 has an inlet 72 through which the food product is drawn through and into the cylinder 52 as the piston assembly 60 is reciprocated in a first direction D1 (up-stroke) toward an extended position (FIG. 6) in which the piston rod 61 extends out of the cylinder 52 and movement of the piston 64 causes a suction force to thereby draw the food product into the cylinder 52. The valve body 70 also has an outlet 74 through which the food product is dispensed from the cylinder 52 as the piston assembly 60 is reciprocated in a second direction D2 (down-stroke) opposite the first direction D1 toward a retracted position (FIG. 8) in which the piston rod 61 is disposed or retracted within the cylinder 52 and the piston 64 applies a pressure or pushing force on the food product within the cylinder 52 to thereby dispense the food product. A valve or series of valve 78 are included to prevent the reverse flow of the food product through the pump 50. That is, the valve or series of valve 78 prevents the food product from being drawn through the outlet 74 on the up-stroke of the piston assembly 60 and/or the dispensed through the inlet 72 on the down-stroke of the piston assembly 60. Reference is made to the above-incorporated U.S. Pat. No. 5,375,746 for further description of example pump components and pump valves and the operation thereof.

Figure 3:
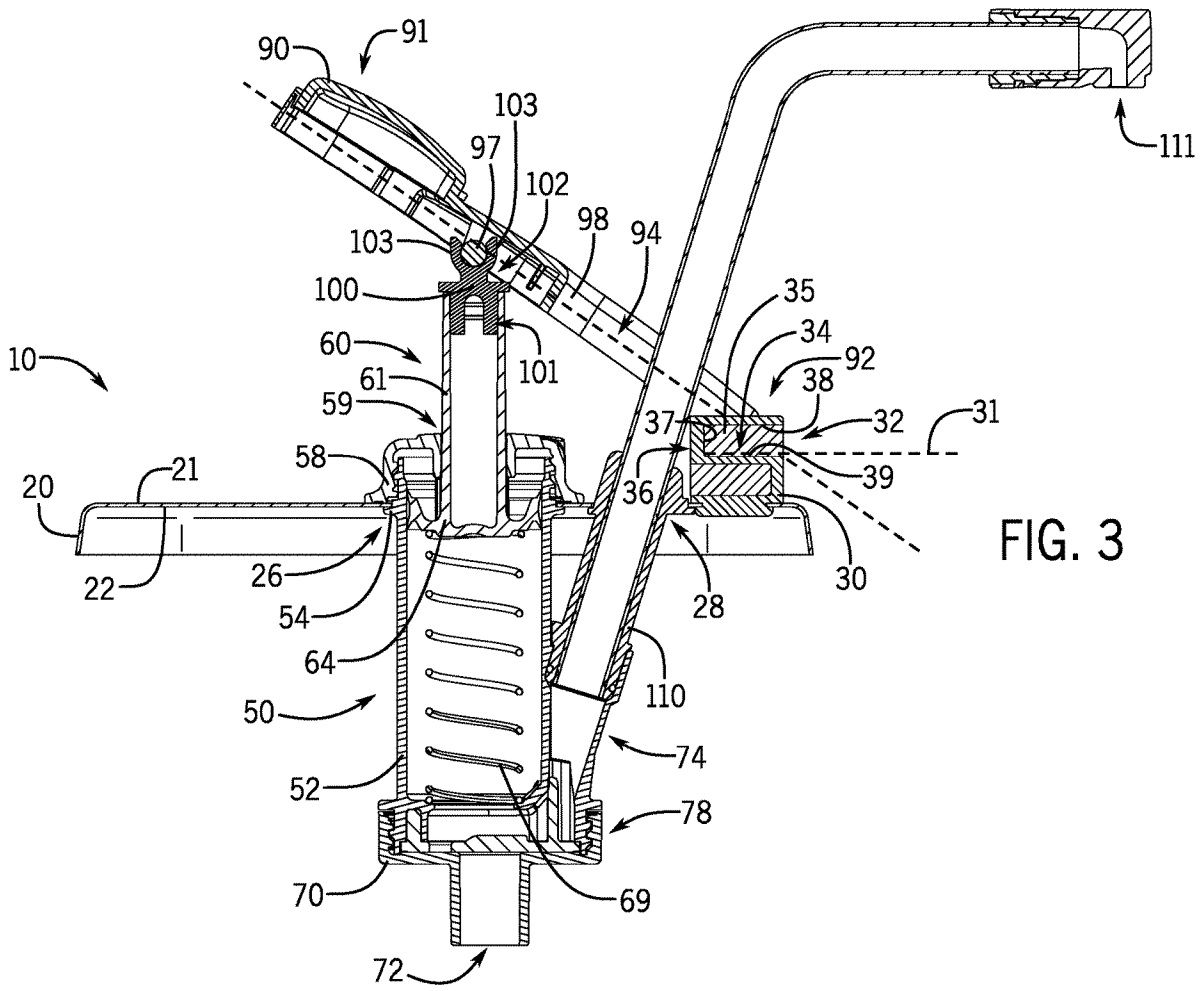
FIG. 3 is a cross sectional view of a pump, a lever, and a lid of the food product dispenser shown in FIG. 1 along line 3-3 on FIG. 2.
Figure 4:
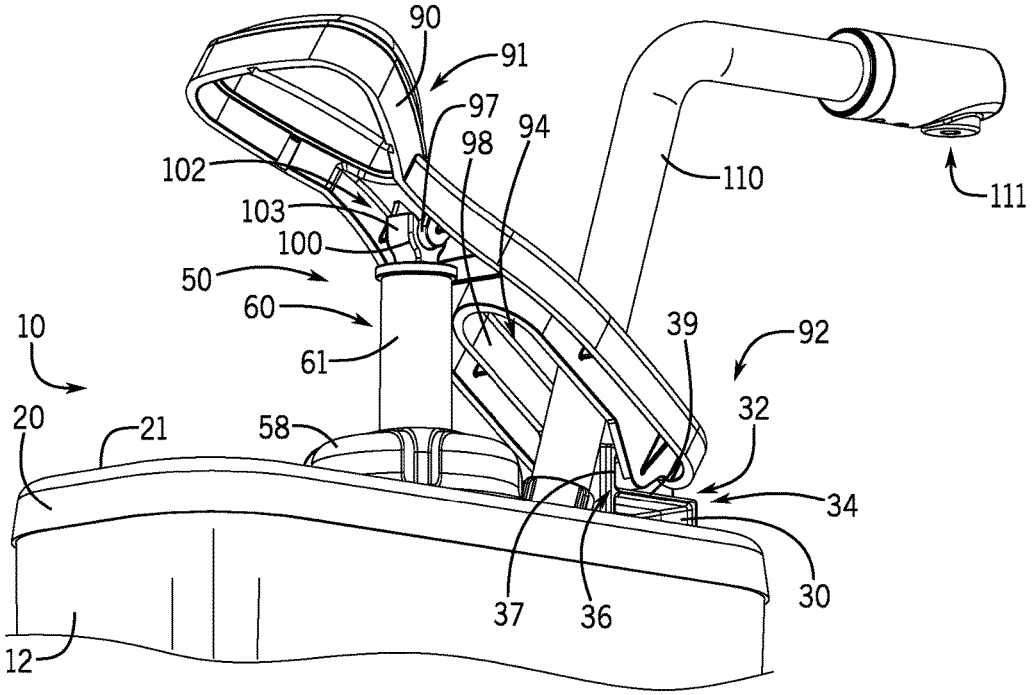
FIG. 4 is a rear perspective view of the food product dispenser shown in FIG. 1.

The pump 50 is actuated by a lever 90 having a piston end 91 coupled to the piston rod 61 of the piston assembly 60 of the pump 50 and an opposite, pivot end 92 slidably coupled to the bracket 30. The pivot end 92 defines a pivot axis 93 about which the lever 90 pivots. The lever 90 extends along a lever axis 95 that is transverse to the pivot axis 93. The lever 90 has an access slot 94 defined by an inner perimeter surface 98 such that the pivot end 92 is a forked end with a pair of arms 105. The pivot end 92 includes a pair of tabs 96 that each protrude from one of the arms 105 and extend along the pivot axis 93 into the access slot 94. The tabs 96 are each slidably received in one of the channels 32 defined by the bracket 30 such that the tabs 96 and the pivot end 92 slides along the plane 31 (FIG. 3).

The lever 90 is pivotably coupled to the piston rod 61 of the piston assembly 60 via a cradle 100 that is attached to the piston rod 61. As shown in FIG. 3, the cradle 100 has a first end 101 that is attached to the piston assembly 60. The type of connection between the first end 101 and the piston assembly 60 can vary, and in the example depicted, the first end 101 is press fit onto or into the piston rod 61 (e.g. snap-fit into the piston rod 61). The cradle 100 has a second end 102 including a pair of curved cradle arms 103. The curved arms 103 are configured to elastically deflect as the cradle arms are positioned around and coupled to an attachment member 97 of the lever 90. The size and shape of the attachment member 97 can vary, and in the example depicted, the attachment member 97 is cylindrical and extends along an axis 99 that is spaced apart and parallel to the pivot axis 93. The cradle arms 103 are positioned on opposing sides of the attachment member 97. As the lever 90 pivots, the cradle arms 103 slide along the outer surface of the attachment member 97 to maintain the connection between the lever 90 and the piston rod 61 while permitting the attachment member 97 and the lever 90 to move or pivot relative to the piston rod 61 and/or the piston assembly 60. In other examples, the attachment member 97 is rotatably coupled to the lever 90 such that as the lever pivots, the attachment member 97 rotates within the cradle 100.

The food product dispenser 10 includes a discharge tube 110 coupled to the outlet 74 (FIG. 3) of the pump 50 and extending through the second hole 28 defined in the lid 20. As the pump 50 is operated, the food product is conveyed through the discharge tube 110 and through a discharge opening 111. The discharge tube 110 is positioned within the access slot 94 of the lever 90 and is spaced apart from the inner perimeter surface 98. The access slot 94 is elongated such that as the lever 90 pivots, the discharge tube 110 remains in the slot and does not contact the inner perimeter surface 98 of the lever. Therefore, the discharge tube 110 does not does not interfere with the pivoting and translating movement of the lever 90.

Figure 6:
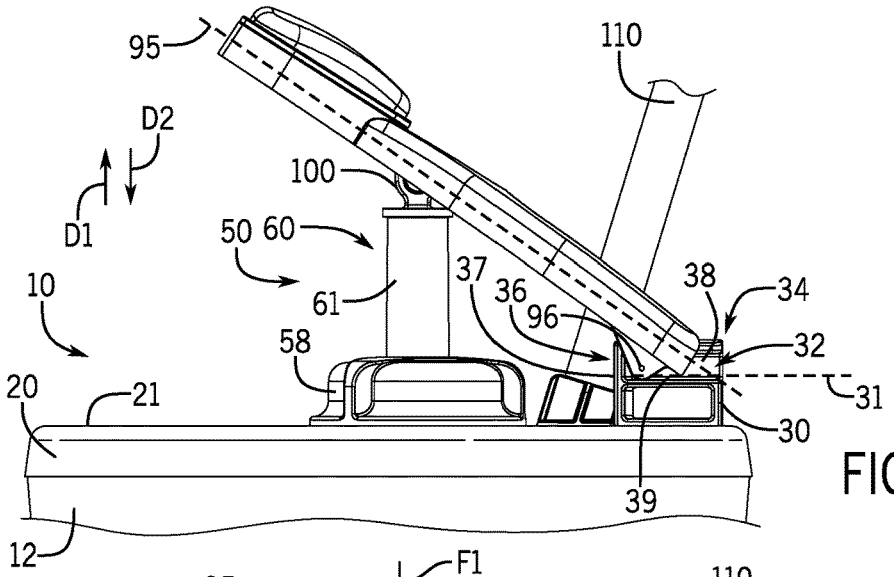
FIG. 6 is a side view of the food product dispenser shown in FIG. 1 with the lever and a piston assembly in an extended position.
Figure 7:
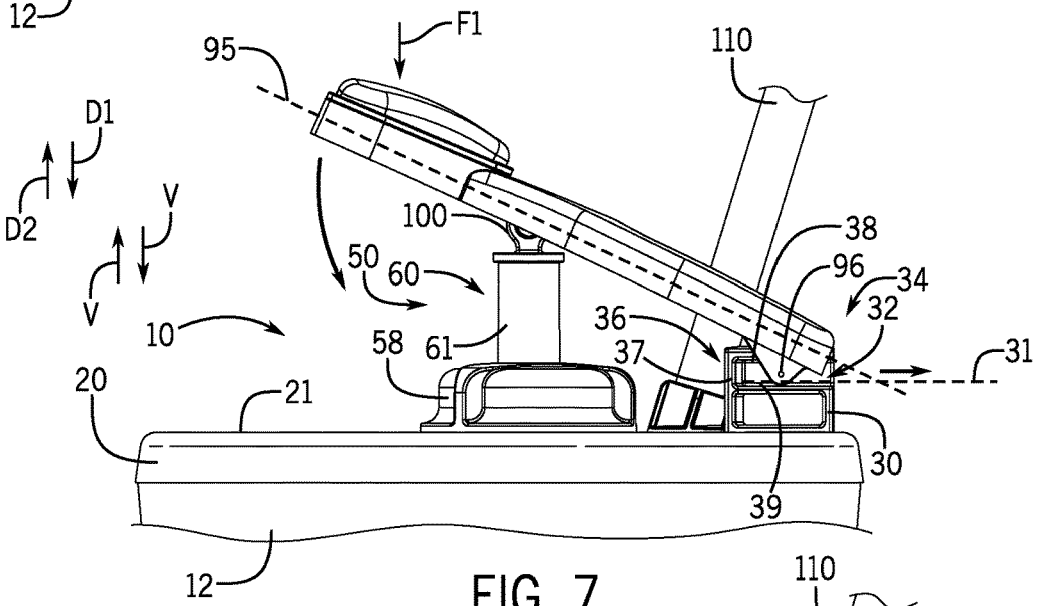
FIG. 7 is a side view of the dispenser shown in FIG. 1 with the lever and piston assembly moving from the extended position to a retracted position.
Figure 8:
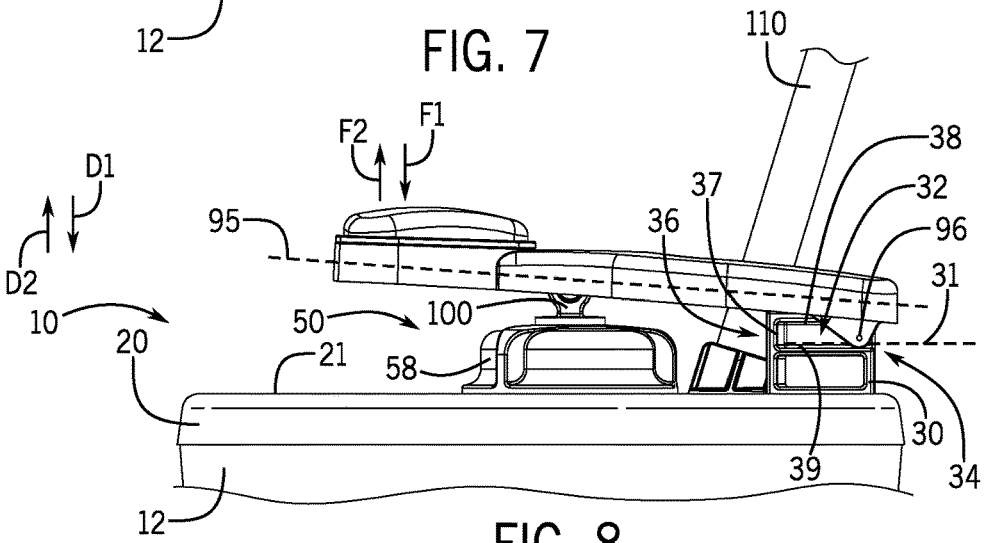
FIG. 8 is a side view of the dispenser shown in FIG. 1 with the lever and piston assembly in the retracted position.

Referring specifically to FIGS. 6-8, an example operational sequence of the food product dispenser 10 is depicted.

FIG. 6 depicts the piston assembly 60 in the extended position and the pair of tabs 96 in the channels 32 at the closed end 36 of the bracket 30. In this position, the discharge tube 110 is at the back of the access slot 94 near the rear portion of the perimeter surface 98.

FIG. 7 depicts a downwardly vertical force F1 being applied to the piston end 91 of the lever 90 such that the lever 90 pivots about the pivot axis 99. At this time, the pivot end 92 begins to move along a plane parallel to the top surface of the lid 20 and the tabs 96 slide in the channels 32 toward the open end 34. The tabs 96 contact and slide along the upper channel surface 38. During actuation of the lever 90, the piston end 91 acts on the piston assembly 60 with a primarily vertical force that reciprocates the piston assembly 60 (down-stroke) and pump the food product from the cylinder 52 and through the discharge tube 110. That is, a primarily vertical downward force is applied to the piston assembly 60 as the pivot end 92 slides along lid 20 within the slide bracket 30. Furthermore, as the piston end 91 is moved toward the lid 20, the attachment member 97 moves or rotates within the cradle 100 such that the piston end 91 acts on the piston assembly with the primarily vertical downward force. The present inventor has recognized that the attachment member 97 and the cradle 100, along with the pivot end 92 sliding in the channel 32, reduces or eliminates lateral forces applied to the piston assembly 60, in comparison to convention food product dispensers. Reduction or elimination of the application of these lateral forces to the piston assembly 60 and/or pump 50 reduces stresses from being applied to the pump 50, the lid 20, and the components thereof thereby increasing the longevity of the components, increasing the operating efficiency of the pump 50 due to more vertical downward forces being applied, and making the food product dispenser 10 earlier to use. In certain examples, the tab 96 contacts the end wall 37 and the end wall 37 prevents further sliding of the tab 96 in the channel 32.

FIG. 8 depicts the piston assembly 60 in the fully depressed retracted position and the tabs 96 moved fully forward in the channels 32 at the open end 34 of the slide bracket 30.

Alternately, when the operator applies a vertically upward force F2 (FIG. 8) to the piston end 91 of the lever 90 when the piston assembly 60 is in the retracted position, the lever 90 pivots about the pivot axis 99 and the piston end 91 moves away from the lid 20. The pivot end 92 slides along the lid 20 in the channels 32 toward the closed end 36, and the tabs 96 contact and slide along the lower channel surface 39. The piston end 91 acts on (pulls) the piston assembly 60 via the attachment member 97 and cradle 100 to thereby reciprocate the piston assembly 60 (up-stroke) to thereby draw the food product into the cylinder 52. In other examples, the pump 50 includes a spring 69 in the cylinder 52 that biases the piston assembly 60 toward the extended position (FIG. 6). In this example, as the piston assembly 60 is moved from the extended position (FIG. 6) to the retracted position (FIG. 8) the spring 69 is compressed, and after the vertically downward force F1 is removed from the lever 90 the spring 69 decompresses and acts on the piston assembly 60 to thereby move the piston assembly 60 from the retracted position (FIG. 8) to the extended position (FIG. 6) and move the piston end 91 of the lever 90 away from the lid 20.

The present inventor has also contemplated that the piston end 91 of the lever 90 can be slidably coupled to the piston assembly 60 and the pivot end 92 of the lever 90 can be pivotably coupled to the lid 20 to thereby function in a similar (though opposite) manner that is described above. That is, the pivot end 92 does not slide along the lid 20 and the piston assembly 60 slides along the piston end 91. However, the piston end 91 still acts on the piston assembly 60 with a primarily vertical downward/upward force to thereby reciprocate the piston assembly 60 and pump the food product.

In one example, the tabs 96 are inserted into the channels 32 via the open end 34 of the bracket 30. The open end 34 is advantageous for insertion and/or removal of the tabs 96 for ease for attachment and/or de-attachment of the lever 90 to the lid 20 during inspection, assembly, and/or cleaning. The attachment member 97 and the cradle 100 are then coupled together. It should be noted that when the piston assembly 60 is in the retracted position (FIG. 8), the tabs 96 remain in the channels 32 between closed end 36 and the open end 34 such that the pivot end 92 remains coupled to the bracket 30 or lid 20.

In the present description, certain terms have been used for brevity, clarity, and understanding. No unnecessary limitations are to be inferred therefrom beyond the requirement of the prior art because such terms are used for descriptive purposes only and are intended to be broadly construed. The different apparatuses, systems, and methods described herein may be used alone or in combination with other apparatuses, systems, and methods. Various equivalents, alternatives and modifications are possible within the scope of the appended claims.

What is claimed is:

1. A food product dispenser for dispensing a food product from a container, the food product dispenser comprising:

a lid configured to couple to the container;

a pump coupled to the lid and having a cylinder and a piston assembly with a piston rod and a piston that is reciprocated in the cylinder, wherein reciprocation of the piston assembly pumps the food product from the container through a discharge tube; and a lever having a piston end pivotably coupled to the piston rod and an opposite, pivot end that contacts and slides on the lid, wherein pivoting of the lever about a pivot axis that extends through the pivot end causes the pivot end and the pivot axis to slide on the lid and the piston end to act on the piston assembly with a primarily vertical force to thereby reciprocate the piston assembly.

2. The food product dispenser according to claim 1, wherein the lid has an upper surface and a slide bracket extending from the upper surface, and wherein slide bracket has a channel in which the pivot end slides.

3. A food product dispenser for dispensing a food product from a container, the food product dispenser comprising:

a lid configured to couple to the container, wherein the lid has an upper surface;

a pump coupled to the lid and having a cylinder and a piston assembly with a piston rod and a piston that is reciprocated in the cylinder, wherein reciprocation of the piston assembly pumps the food product from the container through a discharge tube; and a lever having a piston end pivotably coupled to the piston rod and an opposite, pivot end slidably coupled to the lid, wherein pivoting of the lever about a pivot axis causes the pivot end to slide along the lid and the piston end to act on the piston assembly with a primarily vertical force that reciprocates the piston assembly, and wherein the pivot end slides along a plane that is spaced apart and parallel to the upper surface, and wherein the pivot end has a tab;

wherein the lid includes a slide bracket having a channel that receives the tab; and wherein pivoting of the piston end toward the lid causes the tab of the pivot end to slide in the channel in a first direction, and wherein pivoting of the piston end away from the lid causes the tab of the pivot end to slide in the channel in a second direction opposite the first direction.

4. The food product dispenser according to claim 3, wherein the slide bracket includes a closed end having an endwall, and wherein when the tab contacts the endwall to limit movement of the tab.

5. The food product dispenser according to claim 3, wherein the pivot axis translates along the channel as the tab of the pivot end slides in the channel.

6. The food product dispenser according to claim 4, wherein the piston assembly has a cradle that pivotably couples the lever to the piston rod, and wherein the cradle has a pair of cradle arms that elastically deform as the pair of cradle arms are coupled to the lever.

7. The food product dispenser accordingly to claim 6, wherein the lever has an attachment member with an outer surface, and wherein the pair of cradle arms contact and slide along the outer surface as the lever is pivoted.

8. The food product dispenser according to claim 7, wherein the lever extends along a lever axis, and wherein the attachment member is a cylindrical rod that extends transverse to the lever axis and parallel to the pivot axis.

9. The food product dispenser according to claim 3, wherein the discharge tube extends through lid, wherein the pump is configured to convey the food product through the discharge tube as the piston assembly is reciprocated; and wherein the lever has an inner perimeter surface that defines an access slot in which the discharge tube is disposed.

10. The food product dispenser according to claim 9, wherein the access slot extends from the pivot end such that the pivot end has a pair of arms;

wherein the tab is one tab of a pair of tabs, wherein one tab in the pair of tabs extends from each arm in the pair of arms along the pivot axis and into the access slot;

wherein the channel is one channel of a pair of channels that are separated by a center wall, and wherein the tabs simultaneously slide in the channels as the lever is pivoted.

11. A food product dispenser for dispensing a food product, the food product dispenser comprising:

a container having a cavity configured to receive the food product;

a lid coupled to the container that includes a slide bracket having an open end, an opposite, closed end, and a pair of channels separated by a shared center wall that each extend between the open end and the closed end;

a pump coupled to the lid and having a piston assembly including a piston rod and a piston in a cylinder, and wherein reciprocation of the piston assembly in the cylinder pumps the food product from the container;

a lever having a piston end pivotably coupled to the piston rod and an opposite, pivot end slidably coupled to the lid, wherein the pivot end includes:

an inner perimeter surface that defines an access slot that extends from the pivot end toward the piston end to thereby define two arms; and a tab that extends from each arm along the pivot axis and into the access slot, wherein each tab is slidably and pivotably received in one channel of the pair of channels; and wherein pivoting of the lever about the pivot axis causes the tabs to simultaneously slide in the channels and the piston end act on the piston assembly with a primarily vertical force to thereby reciprocate the piston assembly.

12. The food product dispenser according to claim 11, wherein the lid has an upper surface and wherein the tabs slide along a plane that is parallel to the upper surface.

13. The food product dispenser according to claim 12, wherein pivoting of the piston end toward the lid causes the tabs to slide in the channels toward the open end of the slide bracket, and wherein pivoting of the piston end away from the lid causes the tabs to slide in the channels toward the closed end of the slide bracket.

14. The food product dispenser according to claim 13, wherein the pivot axis translates in the channels as the lever is pivoted.

15. The food product dispenser according to claim 11, wherein the pump further comprising a discharge tube extending through lid, wherein the pump is configured to convey the food product through the discharge tube, and wherein the discharge tube is disposed in the access slot of the lever such that the discharge tube is spaced apart from the inner perimeter surface as the lever is pivoted.

16. The food product dispenser according to claim 13, wherein the piston assembly has a cradle that pivotably couples the lever to the piston rod, and wherein the cradle has a pair of cradle arms that elastically deform as the pair of cradle arms are coupled to the lever.

17. The food product dispenser accordingly to claim 16, wherein the lever has an attachment member with an outer surface, and wherein the pair of cradle arms contact and slide along the outer surface as the lever is pivoted such that the piston end act on the piston assembly with a primarily vertical force.

18. The food product dispenser according to claim 17, wherein the lever has and extends along a lever axis, and wherein the attachment member is a cylindrical rod that extends transverse to the lever axis and parallel to the pivot axis.

* * * * *